US011028512B2

(12) United States Patent
Kobayashi

(10) Patent No.: US 11,028,512 B2
(45) Date of Patent: Jun. 8, 2021

(54) SEWING MACHINE AND NON-TRANSITORY COMPUTER-READABLE MEDIUM

(71) Applicant: BROTHER KOGYO KABUSHIKI KAISHA, Nagoya (JP)

(72) Inventor: Harumi Kobayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 139 days.

(21) Appl. No.: 16/541,486

(22) Filed: Aug. 15, 2019

(65) Prior Publication Data

US 2019/0368096 A1 Dec. 5, 2019

Related U.S. Application Data

(63) Continuation of application No. PCT/JP2017/030297, filed on Aug. 24, 2017.

(30) Foreign Application Priority Data

Feb. 28, 2017 (JP) ..... JP2017-036646

(51) Int. Cl.
*D05C 5/02* (2006.01)
*D05B 19/10* (2006.01)

(52) U.S. Cl.
CPC ..... *D05C 5/02* (2013.01); *D05B 19/10* (2013.01)

(58) Field of Classification Search
CPC . D05C 5/00; D05C 5/02; D05B 19/08; D05B 19/10; D05B 19/12; D05B 69/26
See application file for complete search history.

(56) References Cited

U.S. PATENT DOCUMENTS 6,000,350 A * 12/1999 Koike ..... D05B 19/10 112/102.5
6,167,822 B1 * 1/2001 Miyasako ..... D05B 19/006 112/102.5

(Continued)

FOREIGN PATENT DOCUMENTS

JP H05-123471 A 5/1993
JP 2009-201537 A 9/2009

(Continued)

OTHER PUBLICATIONS

Oct. 17, 2017 International Search Report issued in International Application No. PCT/JP2017/030297.

*Primary Examiner* — Nathan E Durham
(74) *Attorney, Agent, or Firm* — Oliff PLC

(57) ABSTRACT

A sewing machine includes a holder, a movement portion, a needle bar, a sewing portion, an input portion, a processor, and a memory. The memory is configured to store computer-readable instructions that, when executed by the processor, instruct the processor to perform processes. The processes include acquiring embroidery data, associating, for each of a plural pieces of pattern data included in the embroidery data, a sewing position with the pattern data, stopping sewing when partition data included in the embroidery data is read out. The processes include driving, when a sewing start command is received during a stop period, the movement portion and the sewing portion in accordance with a next piece of pattern data and the sewing position, receiving a change command during the stop period, and changing the sewing position associated with target pattern data in accordance with the received change command.

12 Claims, 7 Drawing Sheets

(56) References Cited

U.S. PATENT DOCUMENTS

| | | | | |
|---|---|---|---|---|
| 8,539,893 | B2 * | 9/2013 | Tokura | D05C 9/02 112/103 |
| 8,584,607 | B2 * | 11/2013 | Tokura | D05B 19/12 112/470.01 |
| 2010/0242817 | A1 | 9/2010 | Tokura | |
| 2011/0056419 | A1 | 3/2011 | Taguchi | |
| 2015/0259841 | A1 | 9/2015 | Ihira et al. | |
| 2017/0175314 | A1 | 6/2017 | Suzuki et al. | |

FOREIGN PATENT DOCUMENTS

| | | | |
|---|---|---|---|
| JP | 2010-246885 | A | 11/2010 |
| JP | 2011-055945 | A | 3/2011 |
| JP | 2015-173876 | A | 10/2015 |
| JP | 2016-063882 | A | 4/2016 |
| JP | 2017-109000 | A | 6/2017 |

* cited by examiner

SEWING MACHINE AND NON-TRANSITORY COMPUTER-READABLE MEDIUM

CROSS-REFERENCE TO RELATED APPLICATION

This application is a continuation application of International Application No. PCT/JP2017/030297, filed Aug. 24, 2017, which claims priority from Japanese Patent Application No. 2017-036646, filed on Feb. 28, 2017. The disclosure of the foregoing application is hereby incorporated by reference in its entirety.

BACKGROUND

The present disclosure relates to a sewing machine configured to sew an embroidery pattern, and to a non-transitory computer-readable medium.

A sewing machine configured to sew an embroidery pattern is known. In the known sewing machine, when a plurality of patterns are continuously sewn on mutually different sewing objects, pattern data are sequentially read out from embroidery data including pattern data used for sewing each of the patterns, and the pattern currently being sewn and the pattern to be sewn subsequently are displayed on a display.

SUMMARY

In the known sewing machine, when the sewing is started on the basis of the embroidery data, it is not possible to correct a sewing position of each of the pattern data included in the embroidery data. Thus, in order to change an arrangement of the pattern with respect to the sewing object, it is necessary for a user to change a holding position of the sewing object with respect to an embroidery frame after starting the sewing on the basis of the embroidery data, and this is complex.

Various embodiments of the broad principles derived herein provide a sewing machine and a non-transitory computer-readable medium that facilitate an operation to change an arrangement of a pattern with respect to a sewing object, after a start of sewing on the basis of embroidery data.

A sewing machine comprising:

Embodiments provide a sewing machine that includes a holder, a movement portion, a movement portion, a needle bar, a sewing portion, an input portion, a processor, and a memory. The holder is removably mounted with an embroidery frame configured to hold a sewing object. The movement portion includes a movement motor and is configured to move the holder in two predetermined directions using a driving force of the movement motor. The needle bar has a lower end with which a sewing needle is mountable. The sewing portion includes a drive shaft motor and is configured to move the needle bar up and down using a driving force of the drive shaft motor. The processor is configured to control the movement portion and the sewing portion. The memory is configured to store computer-readable instructions that, when executed by the processor, instruct the processor to perform processes. The processes include acquiring embroidery data to sew a plurality of patterns in a predetermined sewing order. The embroidery data includes a plural pieces of pattern data and at least one piece of partition data. The plural pieces of pattern data and the at least one piece of partition data are alternately allocated in the embroidery data. The plural pieces of pattern data are allocated in the sewing order. Each of the plural pieces of pattern data is the pattern data to sew corresponding pattern from among the plurality of patterns. Each of the at least one piece of partition data represents a boundary between two pieces of the pattern data successive in the sewing order from among the plural pieces of pattern data. The processes include associating, for each of the plural pieces of pattern data included in the embroidery data, a sewing position of the corresponding pattern with the pattern data. The processes include stopping driving of the movement portion and the sewing portion when one of the at least one piece of partition data included in the embroidery data is read out. The processes include driving the movement portion and the sewing portion in accordance with a next piece of pattern data and the sewing position associated with the next piece of pattern data, when a sewing start command is received via the input portion during a stop period in which the driving of the movement portion and the sewing portion is stopped, after starting sewing on the basis of the embroidery data. The next piece of pattern data is next in the sewing order included in the embroidery data. The processes include receiving a change command, which is input via the input portion, to change, for each of at least one piece of target pattern data, the sewing position associated with the pattern data, during the stop period. Each of the at least one piece of target pattern data is the pattern data to sew a target pattern. The target pattern is a target of the change from among the plurality of patterns. The processes include, when the change command is received, changing, for each of the at least one piece of target pattern data, the sewing position associated with the pattern data in accordance with the change command.

Embodiments further provide a non-transitory computer-readable medium that stores computer-readable instructions that are executed by a processor provided in a sewing machine including a movement portion, a sewing portion and an input portion. The computer-readable instructions, when executed, instruct the processor to perform processes. The processor is configured to control the movement portion and the sewing portion. The memory is configured to store computer-readable instructions that, when executed by the processor, instruct the processor to perform processes. The processes include acquiring embroidery data to sew a plurality of patterns in a predetermined sewing order. The embroidery data includes a plural pieces of pattern data and at least one piece of partition data. The plural pieces of pattern data and the at least one piece of partition data are alternately allocated in the embroidery data. The plural pieces of pattern data are allocated in the sewing order. Each of the plural pieces of pattern data is the pattern data to sew corresponding pattern from among the plurality of patterns. Each of the at least one piece of partition data represents a boundary between two pieces of the pattern data successive in the sewing order from among the plural pieces of pattern data. The processes include associating, for each of the plural pieces of pattern data included in the embroidery data, a sewing position of the corresponding pattern with the pattern data. The processes include stopping driving of the movement portion and the sewing portion when one of the at least one piece of partition data included in the embroidery data is read out. The movement portion includes a movement motor and is configured to move a holder in two predetermined directions using a driving force of the movement motor. The holder is removably mounted with an embroidery frame holding a sewing object. The sewing portion includes a drive shaft motor and is configured to move a needle bar up and down using a driving force of the drive shaft motor. The needle bar has a lower end with which a sewing needle is mountable. The processes include driving the movement portion and the sewing portion in accordance with a next piece of pattern data and the sewing position associated with the next piece of pattern data, when a sewing start command is received via the input portion during a stop period in which the driving of the movement portion and the sewing portion is stopped, after starting sewing on the basis of the embroidery data. The next piece of pattern data is next in the sewing order included in the embroidery data. The processes include receiving a change command, which is input via the input portion, to change, for each of at least one piece of target pattern data, the sewing position associated with the pattern data, during the stop period. Each of the at least one piece of target pattern data is the pattern data to sew a target pattern. The target pattern is a target of the change from among the plurality of patterns. The processes include, when the change command is received, changing, for each of the at least one piece of target pattern data, the sewing position associated with the pattern data in accordance with the change command.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. A physical configuration of a multi-needle sewing machine (hereinafter simply called the sewing machine) 1 will be explained with reference to FIG. 1 and FIG. 2. In the explanation that follows, the upper side, the lower side, the lower left side, the upper right side, the upper left side, and the lower right side in FIG. 1 respectively correspond to the upper side, the lower side, the front side, the rear side, the left side, and the right side of the sewing machine 1.

Figure 1:
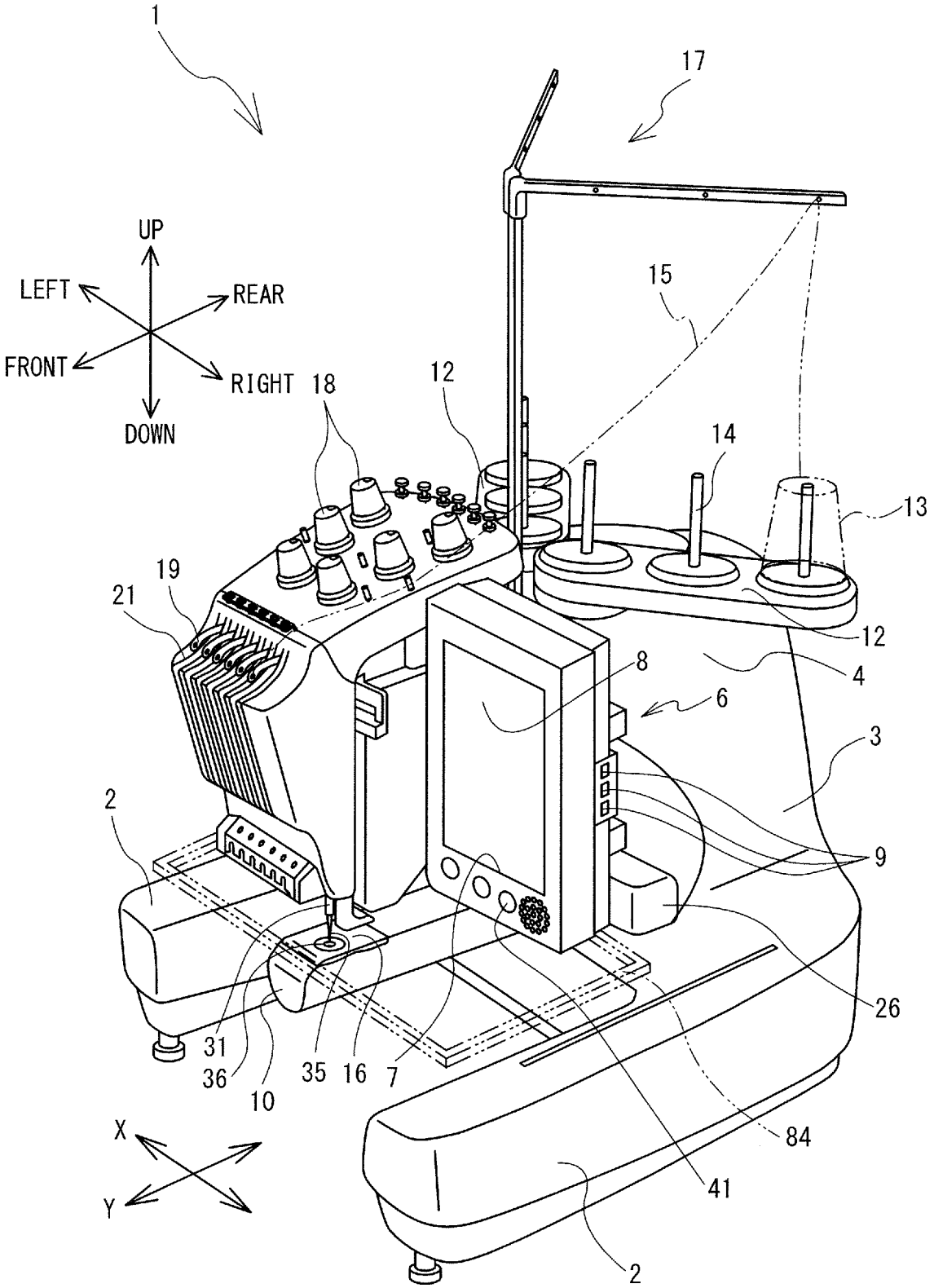
FIG. 1 is a perspective view of a sewing machine.

As shown in FIG. 1, the sewing machine 1 is an embroidery sewing machine configured to sew a pattern. The sewing machine 1 is provided with a support portion 2, a pillar 3, and an arm 4. The support portion 2 supports the entire sewing machine 1. The pillar 3 extends vertically upward from the rear end of the support portion 2. The arm 4 extends toward the front from the upper end portion of the pillar 3, a drive shaft motor 122 (refer to FIG. 2) and a needle bar drive mechanism 32 (refer to FIG. 2) are provided in the interior of the arm 4. A needle bar case 21 is attached to the front end of the arm 4 such that the needle bar case 21 can move in a left-right direction. Six needle bars 31 that extend in the up-down direction are disposed at equal intervals in the left-right direction in the interior of the needle bar case 21. The needle bar drive mechanism 32 is driven by the drive shaft motor 122 as a power source thereof, and, of the six needle bars 31, causes one of the needle bars 31 (a sewing needle bar) that is in a sewing position to move up and down. A sewing needle 35 can be mounted on the lower end of the needle bar 31. A presser foot (not shown in the drawings) is configured to intermittently press the sewing object downward, in concert with the up and down movement of the needle bar 31. The sewing object is a sheet shape, such as a work cloth, leather, a resin sheet or the like.

An operation portion 6 is provided on the arm 4. The operation portion 6 is provided with a liquid crystal display (LCD) 7, a touch panel 8, and a start/stop switch 41. Various types of information that are used when a user inputs a command, for example, may be displayed on the LCD 7. The touch panel 8 is disposed on a front surface side of the LCD 7, and can detect a position that is pressed. When the user performs a pressing operation on the touch panel 8 using a finger or a stylus pen (not shown in the drawings), the pressed position is detected by the touch panel 8. A CPU 61 (refer to FIG. 2) of the sewing machine 1 can detect an item selected on an image, on the basis of the detected pressed position. The user can select a pattern to be sewn and a command to be executed, via the touch panel 8. The start/stop switch 41 is used when issuing a command to start or stop the sewing.

A tube-shaped cylinder head 10 that extends toward the front from the lower end of the pillar 3 is provided below the arm 4. A shuttle (not shown in the drawings) is provided in the interior of the front end of the cylinder head 10. The shuttle may accommodate a bobbin (not shown in the drawings), around which a lower thread (not shown in the drawings) is wound. A shuttle drive mechanism (not shown in the drawings) is provided in the interior of the cylinder head 10. The shuttle drive mechanism is configured to rotationally drive the shuttle. A needle plate 16, which is rectangular in a plan view, is provided on the top face of the cylinder head 10. A needle hole 36, through which the sewing needle 35 may pass, is provided in the needle plate 16. Among the six needle bars 31, the one needle bar 31 that is positioned in the sewing position, which is directly above the needle hole 36, is the sewing needle bar. A Y carriage 26 of a movement mechanism 11 (refer to FIG. 2) is provided below the arm 4. The movement mechanism 11 is provided with an X carriage (not shown in the drawings) and the Y carriage 26. The movement mechanism 11 is configured to move a holder 25 (refer to FIG. 2), with which an embroidery frame 84 is mounted, in two predetermined directions (an X direction and a Y direction). The movement mechanism 11 is able to move to a position indicated by a unique XY coordinate system (an embroidery coordinate system). The X direction and the Y direction of the present embodiment are, respectively, the left-right direction and the front-rear direction. The embroidery frame 84 that holds the sewing object is removably mounted on the holder 25. One embroidery frame selected from among a plurality of types of embroidery frame having mutually different sizes and shapes can be removably mounted on the holder 25 of the present embodiment. A left-right pair of thread spool holders 12 are provided on the rear side of the top face of the arm 4. A plurality of thread spool pins 14 are provided on each of the thread spool holders 12. The thread spool pins 14 are pins that extend in the up-down direction. The thread spool pins 14 may support thread spools 13. Upper threads 15 may be supplied from the thread spools 13 that are disposed on the thread spool holders 12. The upper threads 15 may be supplied through thread guide paths to the eyes (not shown in the drawings) of the corresponding sewing needles 35 that are mounted on the lower ends of the needle bars 31. The thread guide path includes a thread guide 17, tensioners 18, and thread take-up levers 19.

Figure 2:
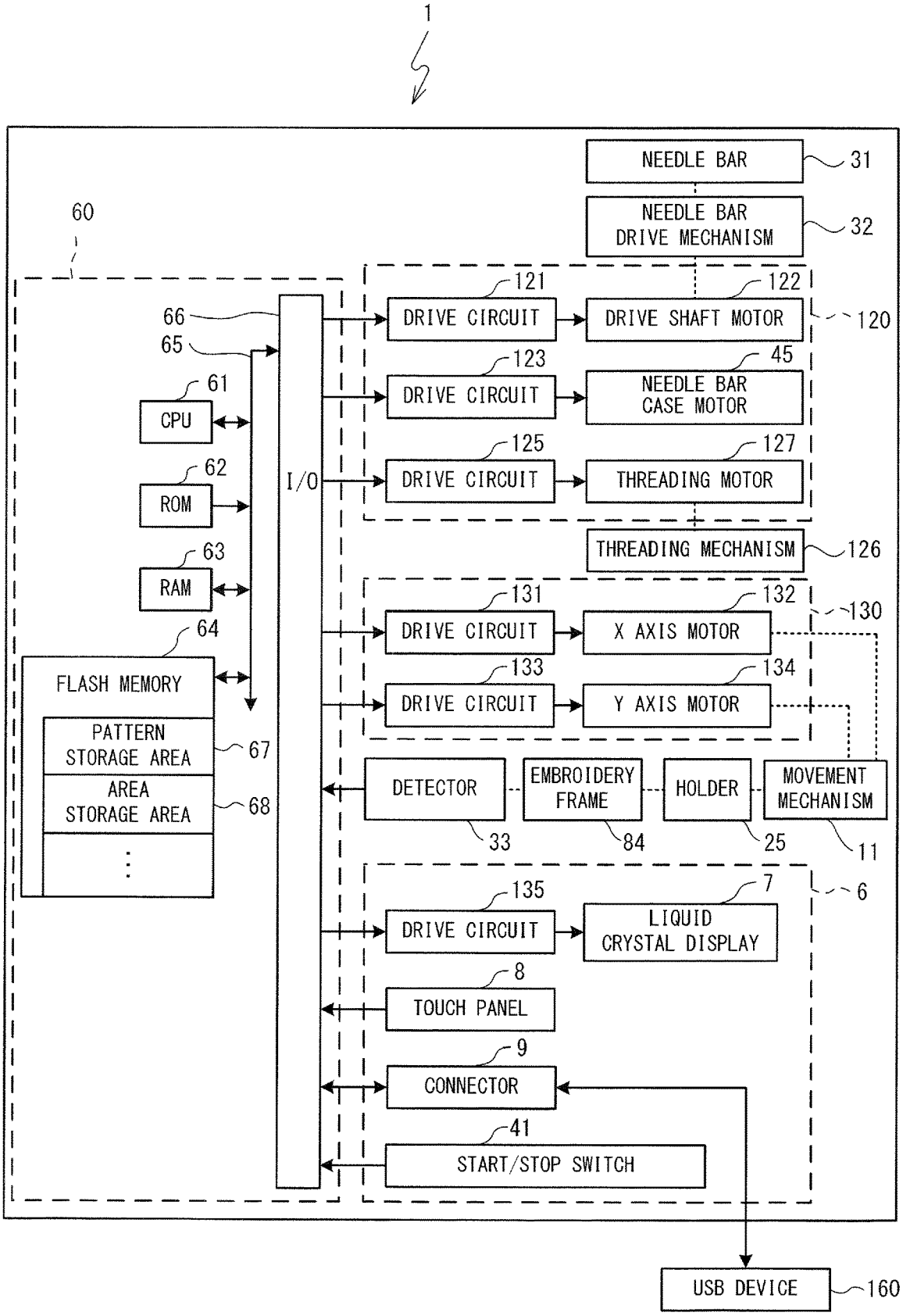
FIG. 2 is a block diagram showing an electrical configuration of the sewing machine.

The electrical configuration that performs overall control of the sewing machine 1 will be explained with reference to FIG. 2. As shown in FIG. 2, the sewing machine 1 is provided with a sewing needle drive portion 120, a sewing target drive portion 130, the operation portion 6, a detector 33 and the control portion 60.

The sewing needle drive portion 120 is provided with drive circuits 121, 123, 125, the drive shaft motor 122, a needle bar case motor 45, and a threading motor 127. The drive shaft motor 122 may move the sewing needle bar reciprocally up and down by operating the needle bar drive mechanism 32. The drive circuit 121 may drive the drive shaft motor 122 in accordance with a control signal from the control portion 60. The needle bar case motor 45 may cause the needle bar case 21 to move in the left-right direction. The drive circuit 123 may drive the needle bar case motor 45 in accordance with a control signal from the control portion 60. The threading motor 127 may cause a threading mechanism 126 to drive. The drive circuit 125 may drive the threading motor 127 in accordance with a control signal from the control portion 60.

The sewing target drive portion 130 is provided with drive circuits 131, 133, an X axis motor 132, and a Y axis motor 134. The X axis motor 132 may move the embroidery frame 84 in the left-right direction by driving the movement mechanism 11. The drive circuit 131 may drive the X axis motor 132 in accordance with a control signal from the control portion 60. The Y axis motor 134 may move the embroidery frame 84 in the front-rear direction by driving the movement mechanism 11. The drive circuit 133 may drive the Y axis motor 134 in accordance with a control signal from the control portion 60.

The operation portion 6 is provided with the touch panel 8, a connector 9, a drive circuit 135, the LCD 7, and the start/stop switch 41. The drive circuit 135 may drive the LCD 7 in accordance with a control signal from the control portion 60. The connector 9 is provided with a function that connects with a USB device 160. The USB device 160 may be a PC or a USB memory, for example. The detector 33 mechanically detects the type of the embroidery frame mounted on the holder 25, and is a rotational potentiometer provided with a function to input, to the control portion 60, a signal that accords with the type of the embroidery frame (For example, refer to Japanese Laid-Open Patent Publication No. 2015-173876, the relevant portions of which are herein incorporated by reference).

The control portion 60 is provided with a CPU 61, a ROM 62, a RAM 63, a flash memory 64, and an input/output interface (I/O) 66, all of which are connected by a bus 65. The I/O 66 is also connected to the detector 33, the sewing needle drive portion 120, the sewing target drive portion 130, and the operation portion 6.

The CPU 61 is configured to perform the main control of the sewing machine 1. In accordance with various types of programs that may be stored in a program storage area (not shown in the drawings) of the ROM 62, the CPU 61 may perform various types of computations and processing that pertain to sewing. The ROM 62 is provided with a plurality of storage areas, including the program storage area, which is not shown in the drawings. Various programs used to operate the sewing machine 1, including a sewing machine program used to execute sewing processing to be described later, are stored in the program storage area. The RAM 63 is a memory element that is freely readable and writable. The RAM 63 is provided, as necessary, with storage areas to store computation results and the like resulting from the computation processing performed by the CPU 61. The flash memory 64 is a readable and writable memory element. Various parameters used for the sewing machine 1 to execute various processing are stored in the flash memory 64. The flash memory 64 includes a pattern storage area 67 and an area storage area 68. The pattern storage area 67 stores, for each of a plurality of patterns, pattern data used to sew the corresponding pattern from among plurality of patterns that can be sewn by the sewing machine 1. The pattern data includes stitch data for each of color switching data. The color switching data is data indicating a color of a thread used to form stitches. The stitch data is data indicating coordinates, of the embroidery coordinate system, of formation positions (needle drop positions) of the stitches included in the patterns. In other words, the stitch data includes data groups indicating a plurality of coordinates for each of needle drop points. The area storage area 68 stores a correspondence between the type of the embroidery frame that can be mounted on the holder 25 and a sewing area. The sewing area is an area on which sewing is possible and which is set inside the embroidery frame mounted on the holder 25 of the sewing machine 1.

Operations to form the stitches on the sewing object held by the embroidery frame 84 will be explained with reference to FIG. 1 and FIG. 2. The embroidery frame 84 that holds the sewing object is supported by the holder 25 of the movement mechanism 11. By moving the needle bar case 21 to the left and the right, one of the six needle bars 31 is selected as the sewing needle bar. The embroidery frame 84 is moved to a predetermined position by the movement mechanism 11. The needle bar drive mechanism 32 and a thread take-up lever drive mechanism are driven by the drive shaft motor 122 as a power source thereof, and the selected needle bar 31 and thread take-up lever 19 corresponding to the selected needle bar 31 are thus driven up and down. Further, the shuttle drive mechanism is driven by the rotation of the drive shaft motor 122, and the shuttle is rotationally driven. In this way, the sewing needle 35, the thread take-up lever 19, and the shuttle are driven in synchronization with each other, and the stitches are formed on the sewing object held by the embroidery frame 84.

An overview of the sewing processing that can be performed by the sewing machine 1 will be explained. The sewing processing is performed when continuously sewing mutually different patterns at mutually different timings on each of a plurality of sewing objects, such as when sewing character patterns representing names onto work clothing, uniforms, or the like. In the sewing processing, the CPU 61 of the control portion 60 acquires an embroidery data used to sew a plurality of patterns in a predetermined sewing order. The embroidery data includes a plural pieces of pattern data and at least one piece of partition data. The plural pieces of pattern data and the at least one piece of partition data are alternately allocated in the embroidery data. The plural pieces of pattern data are allocated in the sewing order. Each of the plural pieces of pattern data is the pattern data to sew corresponding pattern from among the plurality of patterns. Each of the at least one piece of partition data represents a boundary between two pieces of the pattern data successive in the sewing order from among the plural pieces of pattern data. The CPU 61 associates, for each of the plural pieces of pattern data included in the embroidery data, a sewing position of the corresponding pattern with the pattern data. When one of the at least one piece of partition data included in the embroidery data is read out, the CPU 61 stops the driving of the movement mechanism 11 and the needle bar drive mechanism 32. While the sewing is stopped, the user replaces the sewing object, and inputs a start command to start the sewing of the next pattern. When the sewing machine 1 receives the start command via the operation portion 6 during a stop period in which the driving of the movement mechanism 11 and the needle bar drive mechanism 32 is stopped after the start of the sewing on the basis of the embroidery data, the movement mechanism 11 and the needle bar drive mechanism 32 are driven in accordance with the sewing position associated with the present pattern data and the next pattern data in the sewing order included in the embroidery data. During the stop period, the sewing machine 1 is configured to receive, via the operation portion 6, a change command to change for each of at least one piece of target pattern data, the sewing position associated with the pattern data. Each of the at least one piece of target pattern data is the pattern data to sew a target pattern. The target pattern is a target of the change from among the plurality of patterns. When the sewing machine 1 receives the change command, CPU 1 changes, for each of the at least one piece of target pattern data, the sewing position associated with the pattern data in accordance with the change command.

Figure 3:
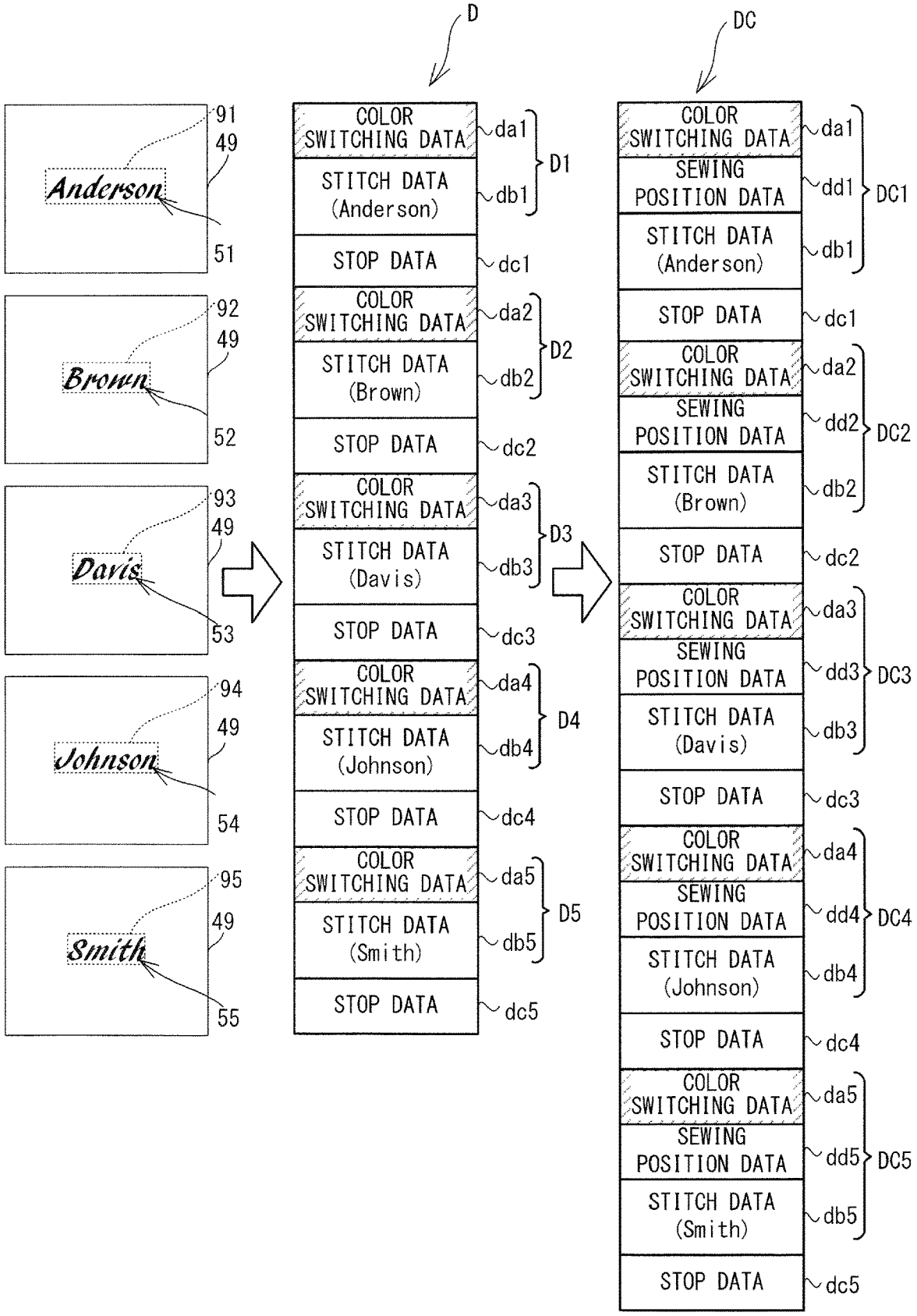
FIG. 3 is an explanatory diagram of processing to assign sewing position data to embroidery data including color switching data, pattern data, and STOP data.

The sewing processing will be explained with reference to FIG. 4 to FIG. 7. For example, a case will be explained in which embroidery data D is acquired in order to sew, in order, five character patterns 51 to 55 shown in FIG. 3 on mutually different sewing objects. As in the example shown in FIG. 3, the embroidery data D of a specific example is data in order to sew, in order, the following five patterns of alphabetic characters: the character pattern 51 representing "Anderson," the character pattern 52 representing "Brown," the character pattern 53 representing "Davis," the character pattern 54 representing "Johnson," and the character pattern 55 representing "Smith." As shown in FIG. 3, by the sewing processing, each of the character patterns 51 to 55 is arranged with respect to a sewing area 49 such that the center of the sewing area 49 is aligned with the center of mask areas 91 to 95 of each of the character patterns 51 to 55. The embroidery data D includes pattern data D1 to D5 to sew each of the character patterns 51 to 55, and STOP data dc1 to dc5. The embroidery data alternately includes the pattern data and the STOP data. The pattern data D1 to D5 respectively include color switching data da1 to da5, and stitch data db1 to db5. The mask area is an area representing a sewing range of the pattern to be sewn in accordance with the pattern data, and, in the present embodiment, is a minimum rectangle encompassing the pattern to be sewn in accordance with the pattern data. Two sides of the four sides of the rectangular mask area extend in the X direction of the embroidery coordinate system, and the other two sides extend in the Y direction. When the CPU 61 of the control portion 60 receives a command to start the sewing processing via the touch panel 8, the CPU 61 performs the sewing processing shown in FIG. 4, on the basis of the program stored in the ROM 62. The command to start the sewing processing may be input by another method.

Figure 4:
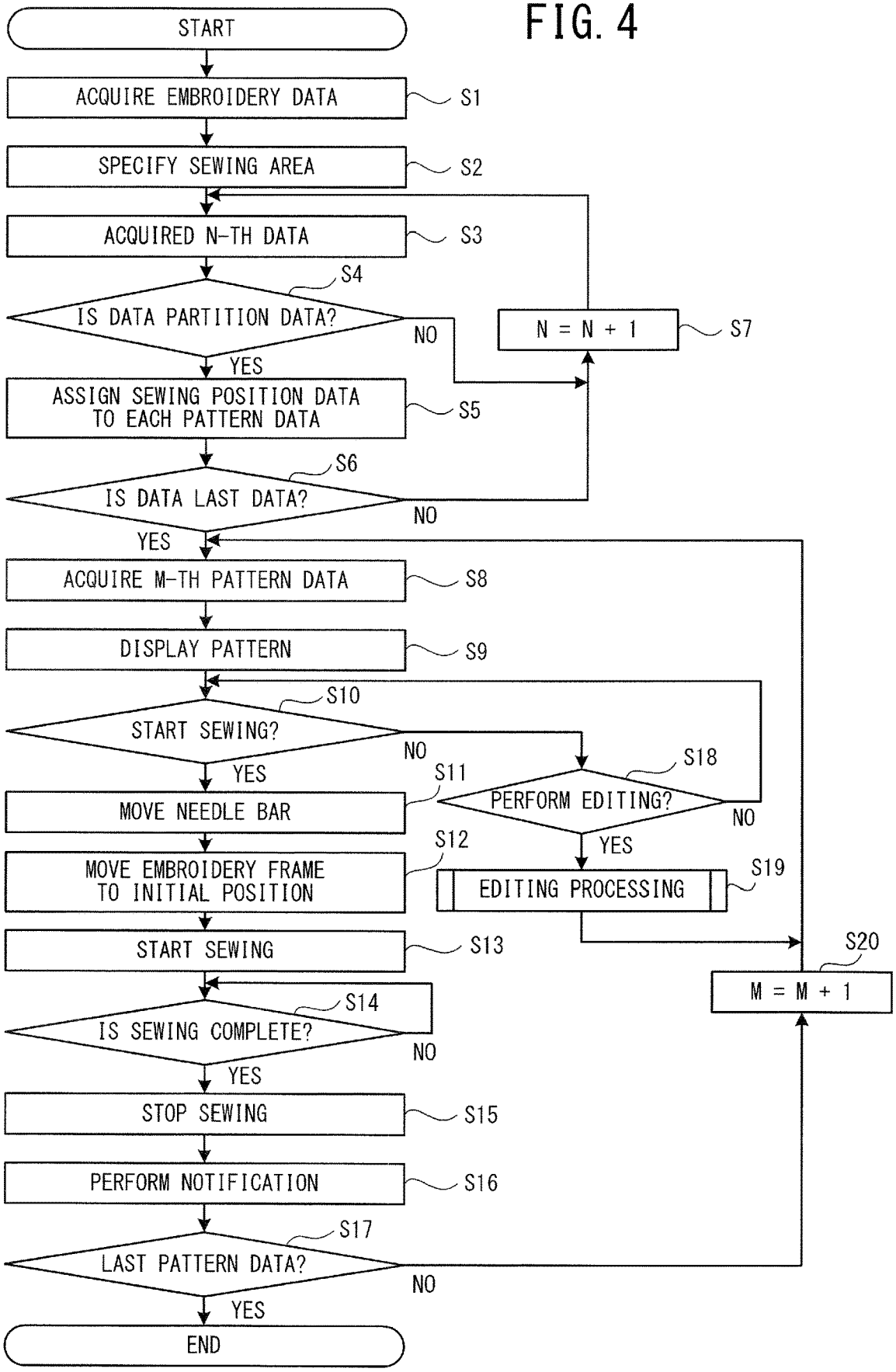
FIG. 4 is a flowchart of sewing processing.

As shown in FIG. 4, the CPU 61 acquires the embroidery data (step S1). The embroidery data may be generated by the sewing machine 1 and acquired by the processing at step S1, or may be generated by an external device, such as a PC or the like, and acquired by the sewing machine 1 via the connector 9 by the processing at step S1. In a specific example, the embroidery data D shown in FIG. 3 is acquired from the PC. The CPU 61 identifies the sewing area (step S2). The CPU 61 of the present embodiment identifies the type of the embroidery frame on the basis of a signal output from the detector 33, refers to the area storage area 68 of the flash memory 64, and identifies the sewing area corresponding to the identified type of the embroidery frame. The CPU 61 acquires N-th data, in an arrangement order, of the embroidery data D acquired by the processing at step S1 (step S3). In the present embodiment, the data included in the embroidery data D shown in FIG. 3 are acquired in order from the top down. An initial value of N is 1, and the first data is the color switching data da1. The CPU 61 determines whether the acquired data is the partition data (step S4). When the acquired data is the STOP data, the CPU 61 of the present embodiment determines that the data is the partition data (yes at step S4).

Since the color switching data da1 is not the STOP data (no at step S4), the CPU 61 increments N by 1 (step S7) and returns the processing to step S3. By the processing repeatedly performed at step S3, when the STOP data dc1 subsequent to the stitch data db1 used to sew the character pattern 51 is acquired (yes at step S4), the CPU 61 performs the association of the sewing position of the character pattern 51 that is sewn using the pattern data D1 including the data immediately preceding the STOP data dc1 (step S5). More specifically, when the sewing position is not assigned to each of the plural pieces of pattern data included in the embroidery data acquired at step S1, the CPU 61 assigns a predetermined value, as the sewing position, to each of the plural pieces of pattern data, and associates the sewing position of the pattern to be sewn by the pattern data, with each of the plural pieces of pattern data included in the embroidery data. The predetermined value of the present embodiment is a value, expressed using the embroidery coordinate system, at which the center of the mask area of the pattern represented by the data is aligned with the center of the sewing area 49. In the pattern data D1 that is the target of the processing, the CPU 61 of the present embodiment inserts sewing position data dd1 between the color switching data da1 and the stitch data db1.

The CPU 61 determines whether the N-th data is the last data of the embroidery data D acquired by the processing at step S1 (step S6). The STOP data dc1 is not the last data (no at step S6). In this case, the CPU 61 increments N by 1 (step S7), and returns the processing to step S3. By repeating the processing at step S5, the sewing position data dd1 to sewing position data dd5 indicating the predetermined values are assigned, as the respective sewing positions, to the five pieces of pattern data D1 to D5 included in the embroidery data D, and the sewing positions of the patterns to be sewn by the pattern data are associated with each of the pattern data included in the embroidery data.

Figure 6:
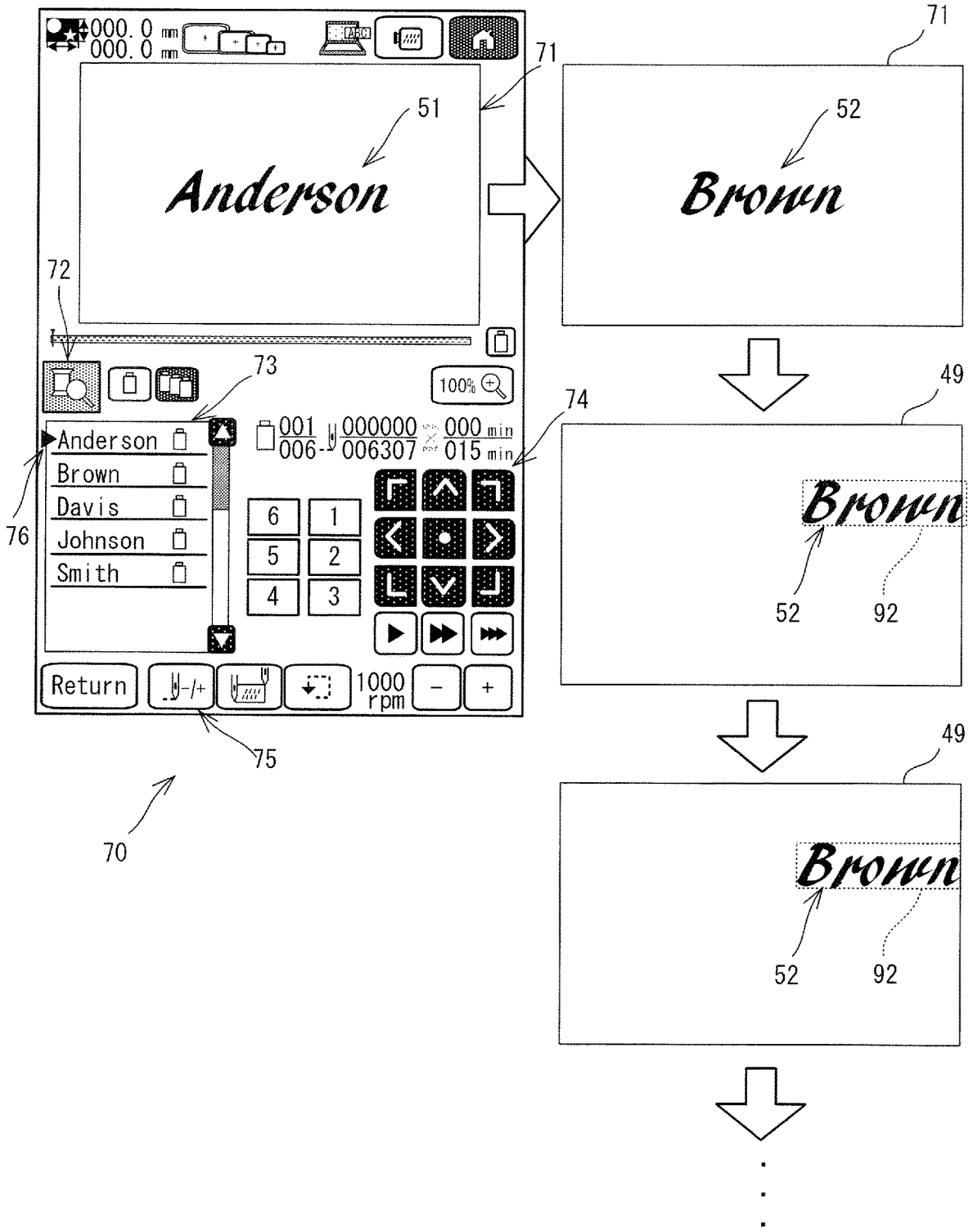
FIG. 6 is an explanatory diagram of screens and processing to change a sewing position.

When the N-th data is the STOP data dc5 that is the last data of the embroidery data D acquired by the processing at step S1 (yes at step S6), the CPU 61 acquires M-th pattern data in the sewing order of embroidery data DC to which the sewing position data dd1 to dd5 have been assigned by the above processing (step S8). An initial value of M is 1, and the CPU 61 acquires pattern data DC1. The CPU 61 displays, on the LCD 7, a finished sewing image of the M-th pattern data (step S9). In the specific example, a screen 70 exemplified in FIG. 6 is displayed. The screen 70 includes a pattern display field 71, a pattern switching key 72, an order display field 73, a pattern moving key 74, a pattern selecting key 75, and a cursor 76. The pattern display field 71 displays the finished sewing image of the pattern currently selected. The pattern display field 71 in FIG. 6 displays the finished sewing image, on the basis of the character pattern 51 representing "Anderson" in alphabetic characters, the color switching data da1, and the stitch data db1. A contour of the pattern display field 71 represents a contour of the sewing area 49. A layout of the character pattern 51 with respect to the pattern display field 71 represents the sewing position of the character pattern 51 set in accordance with the sewing position data dd1.

The pattern switching key 72 is a key used to input a command to switch between whether to select all of the plurality of patterns to be sewn in accordance with the plural pieces of pattern data included in the embroidery data DC acquired at step S1 to which the sewing position data has been assigned, or whether to select a particular one of the plurality of patterns. When all of the plurality of patterns are selected using the pattern switching key 72, a background of the pattern switching key 72 becomes a first color, and when the particular one of the plurality of patterns is selected, the background of the pattern switching key 72 becomes a second color that is different from the first color. In FIG. 6, the first color is shown using white and the second color is shown using vertical stripe shading. In other words, in FIG. 6, the background of the pattern switching key 72 is the second color, and indicates the case in which the particular one of the plurality of patterns is selected.

The order display field 73 displays, in ascending order from top to bottom, the sewing order of the plurality of character patterns 51 to 55 to be sewn in accordance with the embroidery data DC. Of the character patterns displayed in the order display field 73, the character pattern 51 to the left of which the triangular cursor 76 is placed is the selected character pattern when the one particular pattern is selected from among the plurality of patterns. The pattern moving key 74 is a key used to input a command to move the sewing position of the selected pattern. The pattern selecting key 75 is a key used to input a command to change the selected pattern.

The user places the sewing object on the embroidery frame 84, and, after checking the sewing position and the like, inputs the sewing start command. Checking the sewing position can be realized by carrying out a trace function by which the user can ascertain the sewing position with respect to the sewing object in advance, by moving the embroidery frame 84 along with the pattern before the sewing (For example, refer to Japanese Laid-Open Patent Publication No. 2009-201537, the relevant portions of which are herein incorporated by reference.). The CPU 61 determines whether or not the sewing start command has been input via the operation portion 6 (step S10). When the sewing start command has not been input (no at step S10), the CPU 61 determines whether or not a change command to edit the selected pattern has been input (step S18). When the command input using the pattern moving key 74 has been acquired, the CPU 61 of the present embodiment determines that the change command to edit the pattern has been input (yes at step S18). When the change command has not been input (no at step S18), the CPU 61 returns the processing to step S10. When the sewing start command has been input (yes at step S10), the CPU 61 drives the needle bar case motor 45 on the basis of the M-th pattern data acquired at step S8, and sets, as the sewing needle bar, the needle bar 31 for which is set the thread of the color indicated by the color switching data (step S11). When the current sewing needle bar is the needle bar 31 for which the thread is set of the color indicated by the color switching data, the needle bar 31 is not moved at step S11.

The CPU 61 reads out the sewing position data of the M-th pattern data, drives the movement mechanism 11 in accordance with the sewing position data, and moves the embroidery frame 84 to an initial position (step S12). The CPU 61 reads out the stitch data of the M-th pattern data, drives the movement mechanism 11 and the needle bar drive mechanism 32 in accordance with the stitch data, and starts the sewing (step S13). The CPU 61 continues the sewing until the sewing is complete on the basis of the stitch data of the M-th pattern data (no at step S14). When the sewing on the basis of the stitch data of the M-th pattern data is complete and the STOP data has been read out (yes at step S14), the driving of the movement mechanism 11 and the needle bar drive mechanism 32 is stopped (step S15). The CPU 61 displays, on the LCD 7, a message notifying that the sewing on the basis of the M-th pattern data is complete (step S16). The CPU 61 determines whether or not the M-th pattern data is the last pattern data in the sewing order (step S17). When the M-th pattern data is not the last pattern data (no at step S17), the CPU 61 increments M by 1 (step S20), and returns the processing to step S8.

Figure 5:
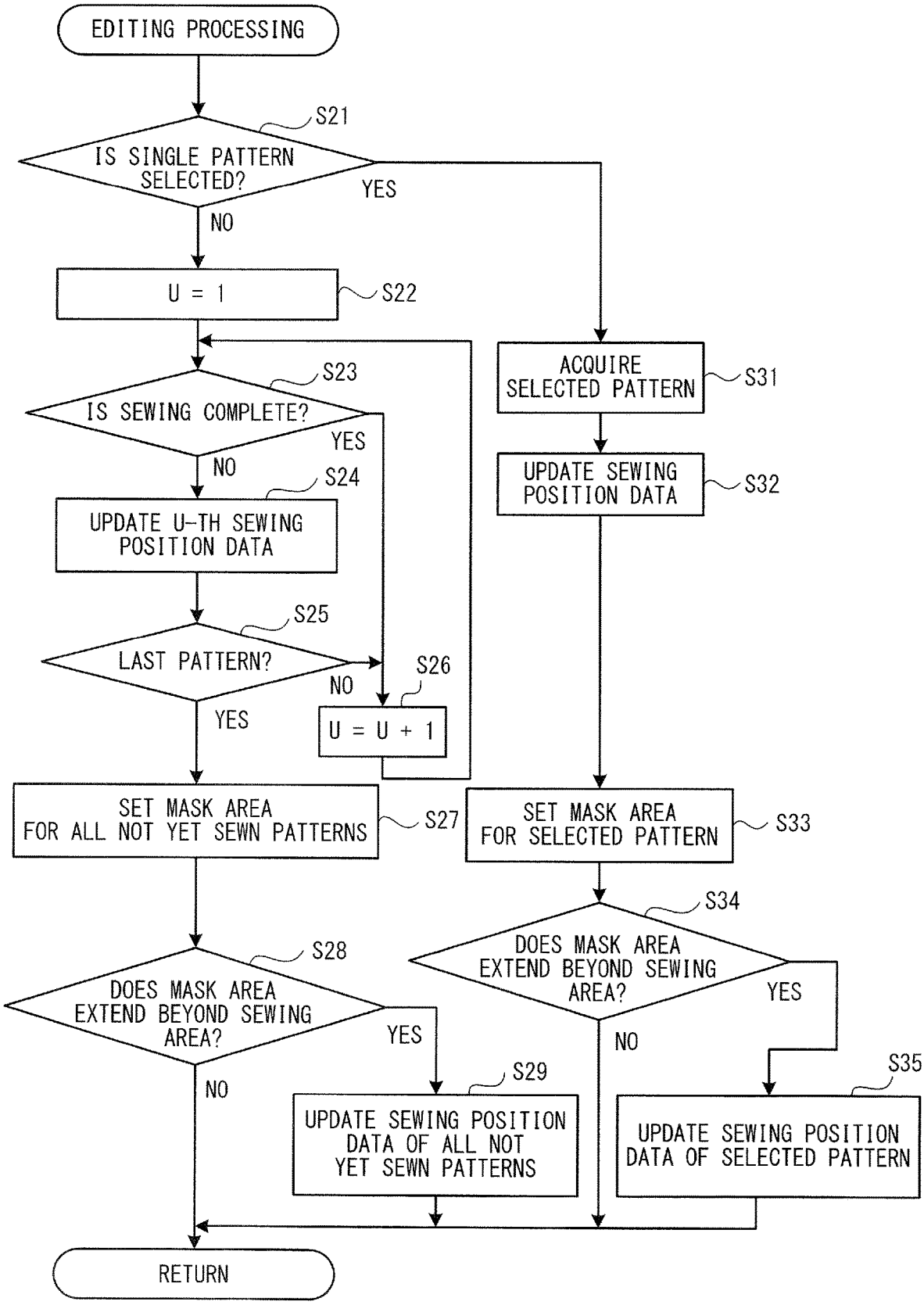
FIG. 5 is a flowchart of editing processing performed in the sewing processing shown in FIG. 4.

After the sewing is complete on the basis of the first pattern data DC1, when second pattern data DC2 that is next in the sewing order is acquired (step S8) while the movement mechanism 11 and the needle bar drive mechanism 32 are stopped (that is to say during the stop period), the character pattern 52 is displayed in the pattern display field 71 (step S9), as shown by the top right diagram in FIG. 6. Further, the selected pattern indicated by the cursor 76 is switched to the pattern represented by the pattern data DC2 acquired at step S8. In this state, when the change command (a first command) input using the pattern moving key 74 is acquired (no at step S10; yes at step S18), the CPU 61 performs editing processing (step S19). As shown in FIG. 5, in the editing processing, the CPU 61 refers to a current setting of the pattern switching key 72, and determines whether the one particular pattern is selected from among the plurality of patterns (step S21). In the specific example, the character pattern 52 is selected that is the one particular pattern among the plurality of character patterns 51 to 55 (yes at step S21). In this case, the CPU 61 acquires the sewing position data associated with the selected character pattern 52 (step S31), and updates the sewing position data of the character pattern 52 (step S32), in accordance with a movement amount of the sewing position of the character pattern 52 indicated by the change command input using the pattern moving key 74.

The CPU 61 sets, as the mask area 92 representing the sewing range of the character pattern 52, a minimum rectangle encompassing the selected character pattern 52 (step S33). When the sewing position of the character pattern 52 is changed in accordance with the sewing position data dd2 updated at step S32, the CPU 61 determines whether the set mask area 92 extends beyond the sewing area 49 (step S34). When, as shown by the second diagram from the top on the right side in FIG. 6, the set mask area 92 extends beyond the sewing area 49 (yes at step S34), the CPU 61 further updates the sewing position data dd2 updated at step S32 (step S35), such that the mask area 92 is inside the sewing area 49. An updating method at step S35 may be set as appropriate. For example, as shown by the lower right diagram in FIG. 6, the sewing position data dd2 may be updated at step S35 such that a movement amount from the sewing position updated at step S32 is at a minimum and the mask area 92 is inside the sewing area 49. By the processing at step S32 and step S35, the CPU 61 changes the sewing position associated with the pattern data used to sew the target pattern, in a range in which the pattern that is the target pattern is inside the identified sewing area 49. When the mask area after the sewing position data update at step S32 does not extend beyond the sewing area 49 (no at step S34), or after the processing at step S35, the CPU 61 ends the editing processing and returns the processing to the sewing processing shown in FIG. 4.

Figure 7:
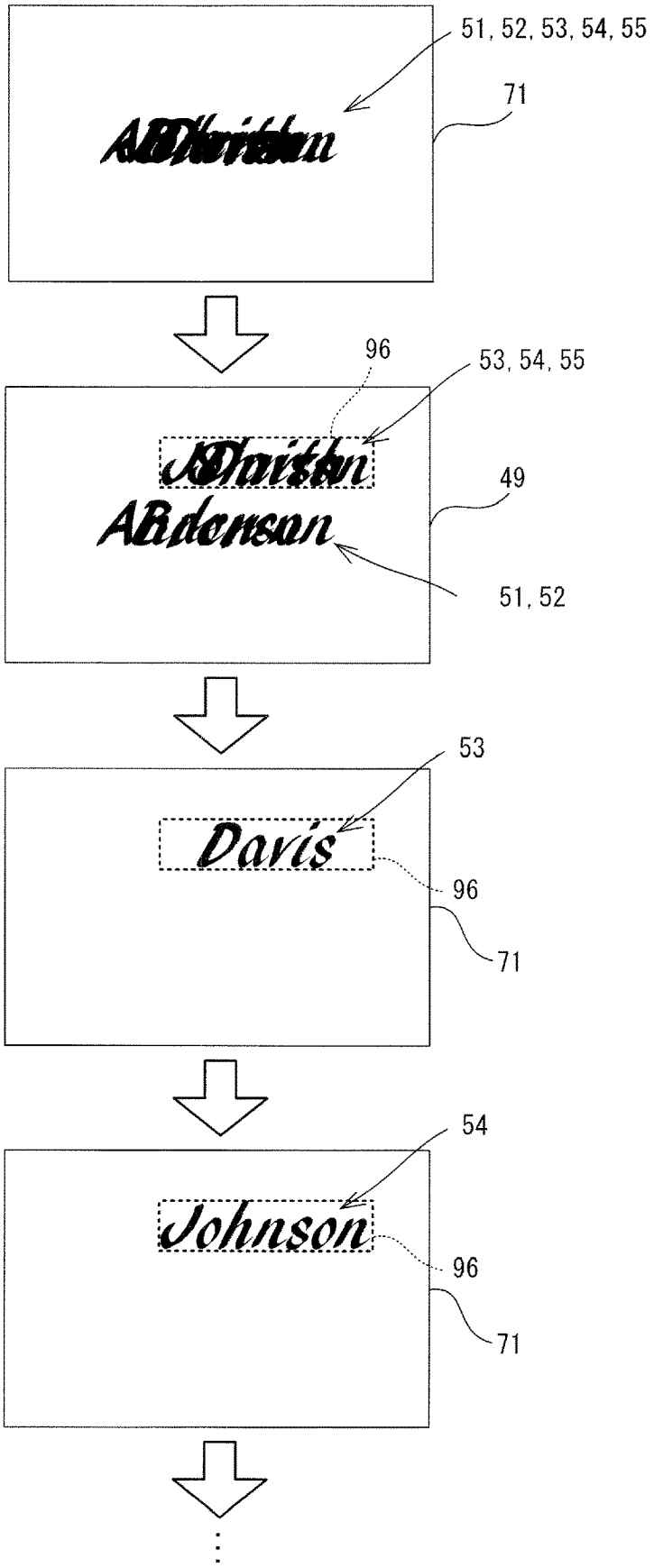
FIG. 7 is an explanatory diagram of the processing to change the sewing position.

When the character pattern 52 has been sewn in the initial position on the basis of the second pattern data DC2, while the movement mechanism 11 and the needle bar drive mechanism 32 are stopped (that is to say during the stop period), third pattern data DC3 is acquired (step S8). Here, if all of the plurality of character patterns are selected as a result of the pattern switching key 72 being operated by the user, the character patterns 51 to 55 are displayed while being overlapped with each other in the pattern display field 71, as shown in FIG. 7 (step S9). In this state, if the change command (a second command) is acquired using the pattern moving key 74 (no at step S10; yes at step S18), the CPU 61 performs the editing processing (step S19). As shown in FIG. 5, in the editing processing, the CPU 61 refers to the current setting of the pattern switching key 72, and determines that all of the plurality of character patterns 51 to 55 are selected (no at step S21). In this case, the CPU 61 sets to 1 a variable U that is used to read out the character patterns 51 to 55 in the sewing order (step S22), and determines whether sewing of a U-th pattern is complete (step S23). In the present embodiment, when U is 1 or 2, which are smaller than M, the CPU 61 determines that the sewing of the U-th pattern is complete (yes at step S23). The CPU 61 increments U by 1 (step S26), and returns the processing to step S23. When U is 3, 4, or 5, which are equal to or greater than M, the CPU 61 determines that the sewing of the U-th pattern is not complete (no at step S23). The CPU 61 updates the sewing position data of the U-th pattern in accordance with a movement amount of the sewing position of the pattern that accords with the change command input using the pattern moving key 74 (step S24). The CPU 61 determines whether the U-th pattern is the last pattern in the sewing order (step S25).

When the variable U is not 5 (no at step S25), the CPU 61 performs the above-described processing at step S26. As shown in the diagram second from the top in FIG. 7, the sewing position data are updated for the not yet sewn character patterns 53 to 55, and the sewing position data for the character patterns 51 and 52, for which the sewing is complete, are not updated. When the variable U is 5 (yes at step S25), the CPU 61 takes all the not yet sewn patterns for which the sewing position data has been updated at step S24 as a single pattern, and sets, as the mask area, a minimum rectangle that encompasses the single pattern (step S27). In a specific example, as shown by the second diagram from the top in FIG. 7, a mask area 96 is set that encompasses the character patterns 53 to 55. The CPU 61 determines whether the mask area 96 set at step S27 extends beyond the sewing area 49 (step S28). When the mask area extends beyond the sewing area 49 (yes at step S28), the CPU 61 further updates each of the sewing position data updated at step S24, such that the mask area is inside the sewing area 49, while maintaining relative positional relationships between the character patterns 53 to 55 (step S29). By the processing at step S24 and step S29, the CPU 61 changes, for each of the plural pieces of target pattern data, the sewing position associated with the pattern data, in a range in which the mask area encompassing all of the plurality of target patterns is inside the sewing area 49. The update method used at step S29 may be set as appropriate, and may be the same as the processing at step S35, for example, or may be different from the processing at step S35. As shown by the diagram second from the top in FIG. 7, when the mask area 96 does not extend beyond the sewing area 49 (no at step S28), or after the processing at step S29, the CPU 61 ends the editing processing and returns the processing to the sewing processing shown in FIG. 4.

When a switching command is received, by an operation of the pattern switching key 72 by the user, in order to switch to a state in which the one particular character pattern is selected, the character pattern 53 is displayed in the pattern display field 71, as shown by the third diagram from the top in FIG. 7 (step S9). In this state, when the start command is acquired (yes at step S10), the character pattern 53 is sewn in accordance with the pattern data DC3. Similarly, after the character pattern 54 is displayed in the pattern display field 71 as shown by the bottom diagram in FIG. 7 (step S9), when the start command is acquired (yes at step S10), the character pattern 54 is sewn in accordance with pattern data DC4. By repeating the processing at step S17, when sewing in accordance with fifth pattern data DC5 is complete (yes at step S17), the CPU 61 ends the sewing processing.

The sewing machine 1 of the above-described embodiment can change the sewing position associated with the pattern to be sewn by the pattern data, while the driving of the movement mechanism 11 and the needle bar drive mechanism 32 is stopped by the processing at step S15 (in other words, during the stop period). It is sufficient for the user to input the change command via the touch panel 8 in order to change the layout of the pattern with respect to the sewing object, after the start of the sewing on the basis of the embroidery data, and the user does not need to change a holding position of the sewing object in relation to the embroidery frame 84. In other words, the sewing machine 1 can simplify an operation to change the layout of the pattern with respect to the sewing object after the start of the sewing on the basis of the embroidery data.

Via the touch panel 8, the sewing machine 1 is configured to receive each of the first command to select one of the target pattern from among the plurality of patterns to be sewn on the basis of the embroidery data to change the sewing position of the one of the target pattern, and the second command to select a plurality of the target patterns from among the plurality of patterns to be sewn on the basis of the embroidery data to change, for each of the plurality of the target pattern, the sewing position associated with the piece of pattern data, via the input portion. When the sewing machine 1 receives the first command as the change command, the sewing machine 1 takes the one piece of pattern data selected in accordance with the first command as the at least one piece of target pattern data, and changes the sewing position associated with the target pattern data (step S32). When the sewing machine 1 receives the second command as the change command, the sewing machine 1 takes, from among the plural pieces of pattern data included in the embroidery data, a plural pieces of selected pattern data corresponding to the plurality of the target patterns selected in accordance with the second command as the at least one piece of target pattern data, and changes, for each of the at least one piece of target pattern data, the sewing position associated with the pattern data, while maintaining relative positional relationships between the plurality of the target patterns (step S24). Thus, the sewing machine 1 can perform the processing in accordance with both the first command and the second command, and in comparison to a sewing machine that can only perform one of the first command and the second command, user convenience can be improved.

When the sewing machine 1 receives the second command as the change command, the sewing machine 1 takes, from among the plural pieces of selected pattern data included in the embroidery data, a plural pieces of pattern data corresponding to the plurality of the target patterns not yet sewn selected in accordance with the second command as the at least one piece of target pattern data (no at step S23), and changes, for each of the at least one pieces of target pattern data, the sewing position associated with the pattern data, while maintaining the relative positional relationships of the not yet sewn plurality of patterns (step S24). Thus, the sewing machine 1 can eliminate the time to change the sewing position of the pattern for which the sewing is complete.

The control portion 60 of the sewing machine 1 identifies the sewing area 49 set for the embroidery frame 84 mounted on the holder 25 (step S2), and changes, for each of the at least one piece of target pattern data, the sewing position associated with the pattern data, in the range in which the pattern that is the target of the change is inside the identified sewing area 49 (step S24, step S28, and step S29; step S32, step S34, and step S35). The sewing machine 1 can avoid a situation in which the target pattern is arranged outside the sewing area 49 and cannot be sewn.

When the sewing area 49 set for the embroidery frame 84 mounted on the holder 25 is identified (step S2) and the plurality of patterns are selected as the patterns that are the target of the change (no at step S21), the control portion 60 of the sewing machine 1 changes, for each of the at least one piece of target pattern data, the sewing position associated with the pattern data in a range in which an area encompassing all of the plurality of patterns is inside the sewing area 49 (step S32, step S34, and step S35). When the plurality of patterns are selected as the target patterns, the sewing machine 1 can avoid a situation in which the target patterns are arranged outside the sewing area 49 and cannot be sewn.

When the sewing position has not been assigned to each of the plural pieces of pattern data included in the embroidery data, the control portion 60 of the sewing machine 1 assigns the predetermined value as the sewing position data to each of the plural pieces of pattern data, and associates, for each of the plural pieces of pattern data, the sewing position with the pattern data (step S5). Thus, the sewing machine 1 can associate the sewing position with each of the plural pieces of pattern data, even when the embroidery data acquired at step S1 is the data in which the sewing position has not been assigned to each of the plural pieces of pattern data.

The sewing machine and the non-transitory computer-readable medium of the present disclosure are not limited to the above-described embodiment, and various modifications may be made insofar as they do not depart from the scope and spirit of the present disclosure. The configuration of the sewing machine 1 may be changed as appropriate. For example, it is sufficient that the sewing machine 1 be provided with one or more of the needle bars 31, and the number, arrangement, and the like of the needle bars 31 may be changed as appropriate. The sewing machine 1 may be a domestic-use embroidery sewing machine, or may be an industrial use sewing machine. It is sufficient that the detector 33 be able to detect the type of the embroidery frame 84 mounted on the holder 25, and may be another device, such as a radio frequency identification device (RFID) or the like. The detector 33 may be omitted as necessary. In addition to the touch panel 8, the input portion may be any type of switch, a voice input device such as a microphone, an ultrasonic input device, or another device, such as an image sensor, a mouse and the like. The sewing machine 1 may be provided with the image sensor, may display an image of the sewing object captured by the image sensor in the pattern display field 71, and may display the pattern based on the embroidery data so as to be overlapped on the image. In this case, the setting of the sewing position of the pattern with respect to the sewing object is easy. A screen layout, items and the like that are displayed when inputting various commands may be changed as appropriate.

The configuration of the embroidery data may be changed as appropriate. An arrangement, inside the embroidery data, of the sewing position data assigned to the embroidery data may be changed as appropriate. The partition data need not necessarily be the STOP data. For example, the partition data may be color switching data. When the stitch data is data representing a relative position in relation to the needle drop position of the preceding stitch, and a first needle drop position included in the stitch data is prescribed in advance, the sewing position may be represented by the first needle drop position included in each of the pattern data. In this case, the CPU 61 does not assign the sewing position data at step S5, and performs the association as information indicating the sewing position as the first needle drop position included in each of the pattern data. At step S24, step S29, step S32, and step S35, the CPU 61 changes the first needle drop position included in the pattern data of the pattern that is the target of the change.

In the sewing processing shown in FIG. 4, in place of the CPU 61, a microcomputer, application specific integrated circuits (ASICs), a field programmable gate array (FPGA) and the like may be used as a processor. The sewing processing may be performed as distributed processing by a plurality of processors. The ROM 62 that stores the program used to execute the sewing processing may be configured by another non-transitory storage medium, such as a flash memory, an HDD and/or SSD, for example. It is sufficient that the non-transitory storage medium be a storage medium able to accumulate and store information, irrespective of a period of storage of the information. The non-transitory storage medium need not necessarily include a transitory storage medium (a transmitted signal, for example). The sewing machine program may be downloaded (namely, transmitted as a transmission signal) from a server connected to a network (not shown in the drawings), for example, and may be stored in an HDD. In this case, it is sufficient that the sewing machine program be stored in a non-transitory storage medium, such as an HDD, provided in the server. An order of each of the steps of the sewing processing of the above-described embodiment can be changed, and a step can be omitted and added as necessary. A case in which an operating system (OS) or the like that operates on the sewing machine 1 on the basis of commands from the CPU 61 of the sewing machine 1 performs part or all of the actual processing and the functions of the above-described embodiment are realized by the processing is also included in the scope of the present disclosure.

A reference point of the sewing position relating to the pattern data may be changed as appropriate. For example, the reference point of the sewing position may be a position of any one of four vertices of the rectangular mask area of the pattern represented by the pattern data with respect to any one of four vertices of the rectangular sewing area. The shape and size of the sewing area and the mask area may be changed as appropriate. A method of identifying the sewing area may be changed as appropriate. For example, the sewing area may be defined by a value input via the input portion (the touch panel 8) by the user. The sewing machine 1 may receive an editing command, such as a command to change the size of or rotate the pattern to be sewn in accordance with the pattern data, after the start of sewing on the basis of the embroidery data, and may change the pattern data in accordance with the editing command. In this case, a method of changing the pattern data may be performed in accordance with a known method. The CPU 61 may receive the change command before starting the sewing of the first pattern on the basis of the embroidery data, or need not necessarily receive the change command.

The control portion 60 may be able to receive only one of the first command and the second command. When the control portion 60 is only able to receive the second command, it is sufficient that the patterns that are the target of the change instructed by the second command are a plurality of the patterns, and they may be all or some of the patterns to be sewn in accordance with the embroidery data. When the control portion 60 acquires the second command, the control portion 60 need not necessarily change, for each of the at least one piece of target pattern data, the sewing position associated with the pattern data of the corresponding pattern while maintaining the relative positional relationships between the plurality of patterns. In this case, for example, the control portion 60 may receive a change command for the arrangement and the like, such as centering, right-aligning, left-aligning and equal spacing, and may change the sewing position in accordance with the received change command. When the control portion 60 receives the second command, with respect to all of the plurality of patterns selected, including the already sewn patterns, the control portion 60 may change, for each of the at least one piece of target pattern data, the sewing positions associated with the pattern data, while maintaining the relative positional relationships between the plurality of patterns, or without maintaining the relative positional relationships between the plurality of patterns.

The control portion 60 may receive the change command in the range in which the pattern that is the target of the change is inside the identified sewing area. When the plurality of the target patterns are selected, the control portion 60 may change the sewing position associated with the pattern data such that the sewing position is inside the sewing area, only for the pattern that is not inside the sewing area when the sewing position is changed in accordance with the second command, and may change the sewing position associated with the pattern data in accordance with the second command for the other patterns.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a holder with which is removably mounted an embroidery frame configured to hold a sewing object;

a movement portion including a movement motor and configured to move the holder in two predetermined directions using a driving force of the movement motor;

a needle bar having a lower end with which a sewing needle is mountable;

a sewing portion including a drive shaft motor and configured to move the needle bar up and down using a driving force of the drive shaft motor;

an input portion;

a processor configured to control the movement portion and the sewing portion; and a memory configured to store computer-readable instructions that, when executed by the processor, instruct the processor to perform processes comprising:

acquiring embroidery data to sew a plurality of patterns in a predetermined sewing order, the embroidery data including a plural pieces of pattern data and at least one piece of partition data, the plural pieces of pattern data and the at least one piece of partition data being alternately allocated in the embroidery data, the plural pieces of pattern data being allocated in the sewing order, each of the plural pieces of pattern data being the pattern data to sew corresponding pattern from among the plurality of patterns, each of the at least one piece of partition data representing a boundary between two pieces of the pattern data successive in the sewing order from among the plural pieces of pattern data;

associating, for each of the plural pieces of pattern data included in the embroidery data, a sewing position of the corresponding pattern with the pattern data;

stopping driving of the movement portion and the sewing portion when one of the at least one piece of partition data included in the embroidery data is read out;

driving the movement portion and the sewing portion in accordance with a next piece of pattern data and the sewing position associated with the next piece of pattern data, when a sewing start command is received via the input portion during a stop period in which the driving of the movement portion and the sewing portion is stopped, after starting sewing on the basis of the embroidery data, the next piece of pattern data being next in the sewing order included in the embroidery data;

receiving a change command, which is input via the input portion, to change, for each of at least one piece of target pattern data, the sewing position associated with the pattern data, during the stop period, each of the at least one piece of target pattern data being the pattern data to sew a target pattern, the target pattern being a target of the change from among the plurality of patterns; and when the change command is received, changing, for each of the at least one piece of target pattern data, the sewing position associated with the pattern data in accordance with the change command.

2. The sewing machine according to claim 1, wherein the receiving the change command includes receiving each of a first command to select one of the target pattern from among the plurality of patterns to be sewn on the basis of the embroidery data to change the sewing position of the one of the target pattern, via the input portion, and a second command to select a plurality of the target patterns from among the plurality of patterns to be sewn on the basis of the embroidery data to change, for each of the plurality of the target patterns, the sewing position associated with the piece of pattern data, via the input portion, and the changing the sewing position includes when the first command is received as the change command, taking the one piece of pattern data selected in accordance with the first command as the at least one piece of target pattern data, and changing the sewing position associated with the pattern data, and when the second command is received as the change command, taking, from among the plural pieces of pattern data included in the embroidery data, a plural pieces of selected pattern data corresponding to the plurality of the target patterns selected in accordance with the second command as the at least one piece of target pattern data, and changing, for each of the at least one piece of target pattern data, the sewing position associated with the pattern data, while maintaining relative positional relationships between the plurality of the target patterns.

3. The sewing machine according to claim 2, wherein the changing the sewing position includes, taking, from among the plural pieces of selected pattern data selected in accordance with the second command, a plural pieces of pattern data corresponding to the plurality of the target patterns not yet sewn as the at least one piece of target pattern data, and changing, for each of the at least one piece of target pattern data, the sewing position associated with the pattern data, while maintaining relative positional relationships between the plurality of the target patterns.

4. The sewing machine according to claim 2, wherein the computer-readable instructions further instruct the processor to perform a process comprising:

identifying a sewing area set in the embroidery frame mounted on the holder, and the changing the sewing position includes, when the plurality of the target patterns are selected, changing, for each of the at least one piece of target pattern data, the sewing position associated with the pattern data in a range in which an area encompassing all of the plurality of the target patterns is inside the sewing area.

5. The sewing machine according to claim 1, wherein the computer-readable instructions further instruct the processor to perform a process comprising:

identifying a sewing area set in the embroidery frame mounted on the holder, and the changing the sewing position includes changing, for each of the at least one piece of target pattern data, the sewing position associated with the pattern data, in a range in which the target pattern is inside the identified sewing area.

6. The sewing machine according to claim 1, wherein the associating the sewing position with the pattern data includes, when the sewing position is not assigned to each of the plural pieces of pattern data included in the embroidery data, assigning a predetermined value, as the sewing position, to each of the plural pieces of pattern data, and associating, for each of the plural pieces of pattern data, the sewing position with the pattern data.

7. A non-transitory computer-readable medium storing computer-readable instructions that are executed by a processor provided in a sewing machine including a movement portion, a sewing portion and an input portion, the computer-readable instructions, when executed, instructing the processor to perform processes comprising:

acquiring embroidery data to sew a plurality of patterns in a predetermined sewing order, the embroidery data including a plural pieces of pattern data and at least one piece of partition data, the plural pieces of pattern data and the at least one piece of partition data being alternately allocated in the embroidery data, the plural pieces of pattern data being allocated in the sewing order, each of the plural pieces of pattern data being the pattern data to sew corresponding pattern from among the plurality of patterns, each of the at least one piece of partition data representing a boundary between two pieces of the pattern data successive in the sewing order from among the plural pieces of pattern data;

associating, for each of the plural pieces of pattern data included in the embroidery data, a sewing position of the corresponding pattern with the pattern data;

stopping driving of the movement portion and the sewing portion when one of the at least one piece of partition data included in the embroidery data is read out, the movement portion including a movement motor and being configured to move a holder in two predetermined directions using a driving force of the movement motor, the holder being removably mounted with an embroidery frame holding a sewing object, the sewing portion including a drive shaft motor and being configured to move a needle bar up and down using a driving force of the drive shaft motor, and the needle bar having a lower end with which a sewing needle is mountable;

driving the movement portion and the sewing portion in accordance with a next piece of pattern data and the sewing position associated with the next piece of pattern data, when a sewing start command is received via the input portion during a stop period in which the driving of the movement portion and the sewing portion is stopped, after starting sewing on the basis of the embroidery data, the next piece of pattern data being next in the sewing order included in the embroidery data;

receiving a change command, which is input via the input portion, to change, for each of at least one piece of target pattern data, the sewing position associated with the pattern data, during the stop period, each of the at least one piece of target pattern data being the pattern data to sew a target pattern, the target pattern being a target of the change from among the plurality of patterns; and when the change command is received, changing, for each of the at least one piece of target pattern data, the sewing position associated with the pattern data in accordance with the change command.

8. The non-transitory computer-readable medium according to claim 7, wherein the receiving the change command includes receiving each of a first command to select one of the target pattern from among the plurality of patterns to be sewn on the basis of the embroidery data to change the sewing position of the one of the target pattern, via the input portion, and a second command to select a plurality of the target patterns from among the plurality of patterns to be sewn on the basis of the embroidery data to change, for each of the plurality of the target patterns, the sewing position associated with the piece of pattern data, via the input portion, and the changing the sewing position includes when the first command is received as the change command, taking the one piece of pattern data selected in accordance with the first command as the at least one piece of target pattern data, and changing the sewing position associated with the pattern data, and when the second command is received as the change command, taking, from among the plural pieces of pattern data included in the embroidery data, a plural pieces of selected pattern data corresponding to the plurality of the target patterns selected in accordance with the second command as the at least one piece of target pattern data, and changing, for each of the at least one piece of target pattern data, the sewing position associated with the pattern data, while maintaining relative positional relationships between the plurality of the target patterns.

9. The non-transitory computer-readable medium according to claim 8, wherein the changing the sewing position includes, taking, from among the plural pieces of selected pattern data selected in accordance with the second command, a plural pieces of pattern data corresponding to the plurality of the target patterns not yet sewn as the at least one piece of target pattern data, and changing, for each of the at least one piece of target pattern data, the sewing position associated with the pattern data, while maintaining relative positional relationships between the plurality of the target patterns.

10. The non-transitory computer-readable medium according to claim 8, wherein the computer-readable instructions further instruct the processor to perform a process comprising:

identifying a sewing area set in the embroidery frame mounted on the holder, and the changing the sewing position includes, when the plurality of the target patterns are selected, changing, for each of the at least one piece of target pattern data, the sewing position associated with the pattern data in a range in which an area encompassing all of the plurality of the target patterns is inside the sewing area.

11. The non-transitory computer-readable medium according to claim 7, wherein the computer-readable instructions further instruct the processor to perform a process comprising:

identifying a sewing area set in the embroidery frame mounted on the holder, and the changing the sewing position includes changing, for each of the at least one piece of target pattern data, the sewing position associated with the pattern data, in a range in which the target pattern is inside the identified sewing area.

12. The non-transitory computer-readable medium e according to claim 7, wherein the associating the sewing position with the pattern data includes, when the sewing position is not assigned to each of the plural pieces of pattern data included in the embroidery data, assigning a predetermined value, as the sewing position, to each of the plural pieces of pattern data, and associating, for each of the plural pieces of pattern data, the sewing position with the pattern data.

* * * * *